United States Patent [19]

Stillwagon

[11] Patent Number: 5,058,405

[45] Date of Patent: Oct. 22, 1991

[54] KEY CHAIN WITH STORAGE COMPARTMENT

[75] Inventor: Woodrow C. Stillwagon, Fulton, Ga.

[73] Assignee: Stillwagon Applied Technology Incorporated, Columbus, Ohio

[21] Appl. No.: 562,638

[22] Filed: Aug. 6, 1990

[51] Int. Cl.[5] ..... A47G 29/10

[52] U.S. Cl. ..... 70/456 R; 70/63

[58] Field of Search ..... 70/456 R, 459, 63; 24/3 K; 150/131; D3/61, 62, 64

[56] References Cited

U.S. PATENT DOCUMENTS 2,232,333 2/1941 McGeher ..... 70/456 R 4,165,459 8/1988 Edwards ..... 70/456 R

*Primary Examiner*—Robert L. Wolfe

*Attorney, Agent, or Firm*—Louis T. Isaf

[57] ABSTRACT

A key chain with interior storage compartment closed by a cap to seal in solids, such as heart medication tablets or diabetes medication and which, preferably, is designed to additionally seal a container or vial which fits within the compartment for storing liquids, such as perfume, cologne, breath freshener, etc. which also features two key rings with a quick release mechanism to allow separation of the two rings.

21 Claims, 3 Drawing Sheets

KEY CHAIN WITH STORAGE COMPARTMENT

FIELD OF THE INVENTION

This invention relates generally to key chains, and specifically to key chains which can be separated into two parts.

BACKGROUND OF THE INVENTION

Numerous key chain designs are in use today, from simple key rings to deluxe key cases finished to match accessory items, such as wallets and purses. Some are designed to include two ring portions which can be separated temporarily. With such a two ring key chain, keys can be divided logically with one group of keys, such as keys for the home, on one ring and another group of keys, such as car or office, on the second ring.

The ability to separate home or office keys from car keys provides an extra measure of safety which often comes in handy when leaving a car for service, or with valet parking, etc. Doing so greatly reduces the chances of home or office keys falling into the wrong hands. Most people probably consider separating car keys from the rest of their keys when leaving their car with a stranger; making this easier to do increases the likelihood of actually following through with the idea.

Key chains are usually carried in a pocket or purse, where space is often at a premium; many people prefer to "travel light", and take the attitude that the fewer items carried, the better. One means of achieving this goal is to combine two or more items, which are usually carried separately, in a single container.

SUMMARY OF THE INVENTION

Briefly described, the present invention comprises a key chain with an inner storage compartment. The inner storage compartment is closed by a cap to seal in solids, such as heart medication tablets or diabetes medication. The compartment cap is designed to additionally seal a container or vial which fits within the compartment for storing liquids, such as perfume, cologne, breath freshener, etc.

The preferred embodiment of the present invention is a two ring key chain, with a push button release to allow separation of the two rings. One ring in the preferred embodiment is attached to an inner body member which can be held within an outer body member, to which another ring is attached; the push button release mechanism allows separation of the inner and outer body members. In this embodiment, the inner storage compartment is inside the inner body member.

Although the preferred embodiment includes a two ring key chain, which can be separated into two parts, with only one of the parts after separation containing a storage compartment, other embodiments are contemplated which have a different number of rings or parts and other compartmental arrangements. For example, another embodiment of the invention comprises a body member, with a storage compartment accessible from one side and a key ring mounted on another side.

It is therefore an object of the present invention to provide a key chain which includes a storage compartment for articles other than keys.

Another object of the present invention is to provide a key chain which includes a storage compartment and more than one ring, with at least one ring being detachably mounted to the key chain.

Yet another object of the present invention is to provide a push button, quick release mechanism to allow easy separation of a ring from the key chain.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
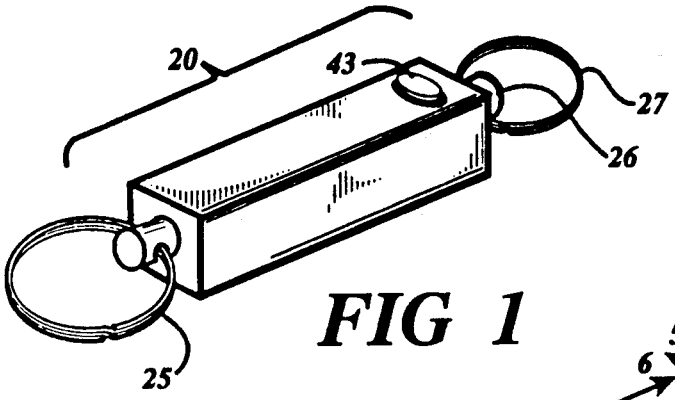
FIG. 1 is a pictorial view of the preferred embodiment of the present invention, with the two body members joined together.
Figure 2:
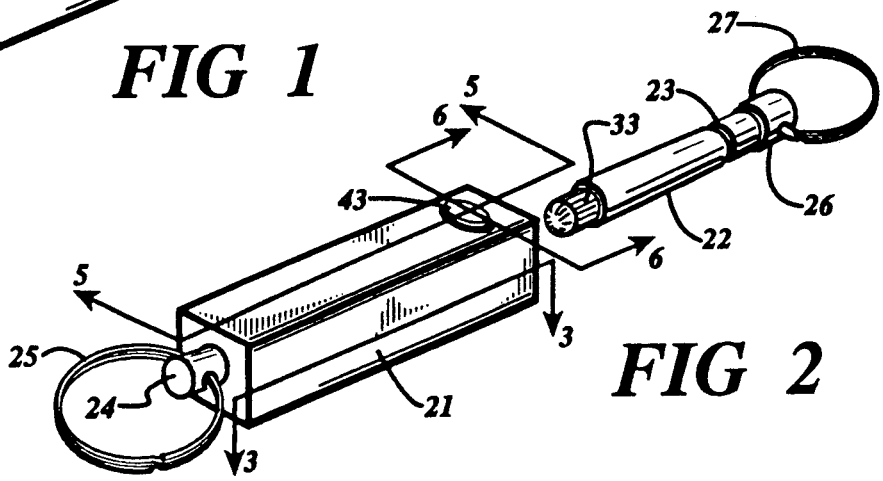
FIG. 2 is a pictorial view of the embodiment of FIG. 1, showing the two body members separated.
Figure 5:
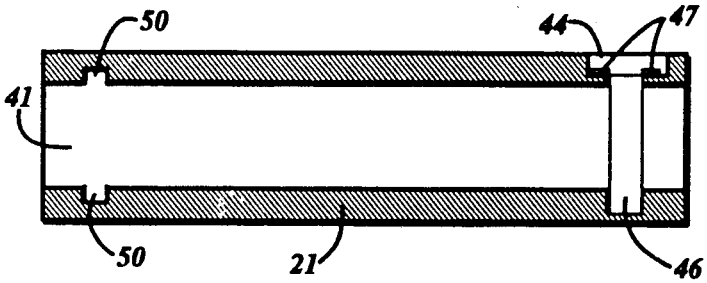
FIG. 5 is a cross section of the outer body member of the embodiment of FIG. 1 taken along line 5—5 of FIG. 2.

Referring now in greater detail to the drawings, in which like numerals represent like components throughout the several views, the preferred embodiment of the key chain 20 of the present invention is shown in FIGS. 1 through 6 as including an outer body 21 and an inner body 22 which can be attached, as in FIG. 1, or separated into two parts, as shown in FIG. 2. When attached, inner body 22 is inserted into outer body 21 cavity 41. Also shown in FIG. 1 are outer body key ring 25 and inner body key ring 27, which are attached to their respective body members 21 and 22 with ring attachments 24 and 26.

Figure 3:
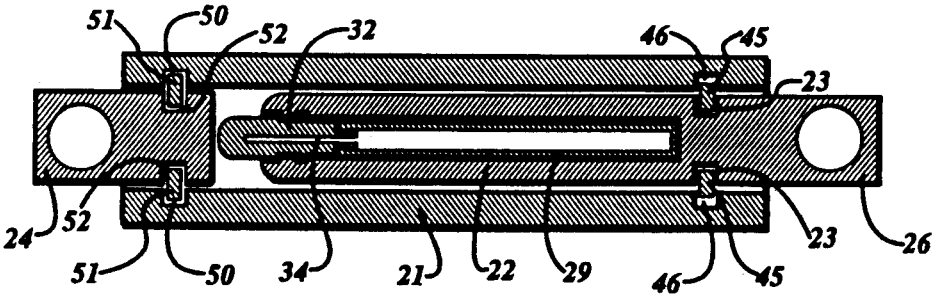
FIG. 3 is a cross section of the embodiment of FIG. 1, taken along line 3—3 of FIG. 2.
Figure 4:
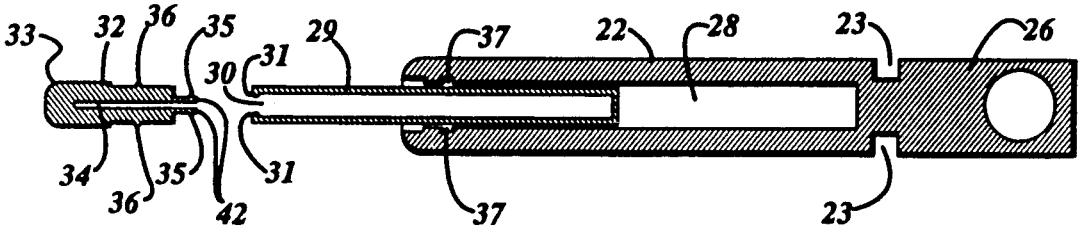
FIG. 4 is an exploded cross section of the inner body member of the embodiment of FIG. 1.
Figure 9:
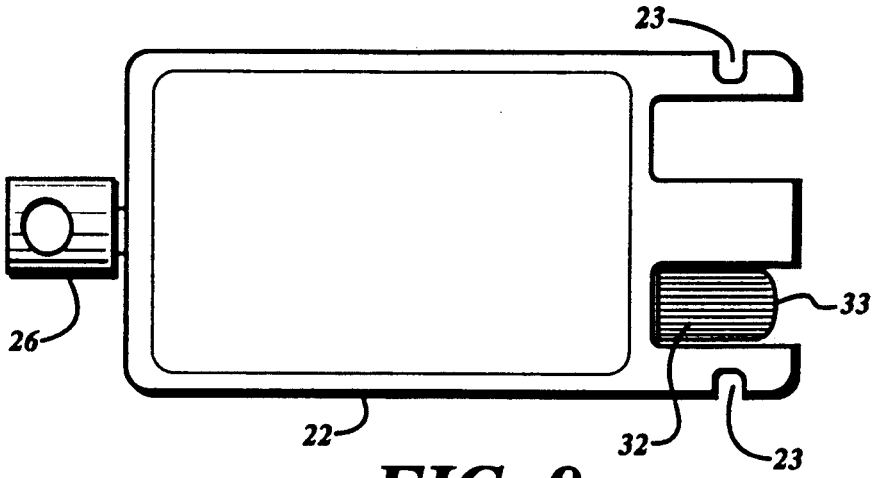
FIG. 9 is a top view of the inner body member of the embodiment of FIG. 7.
Figure 10:
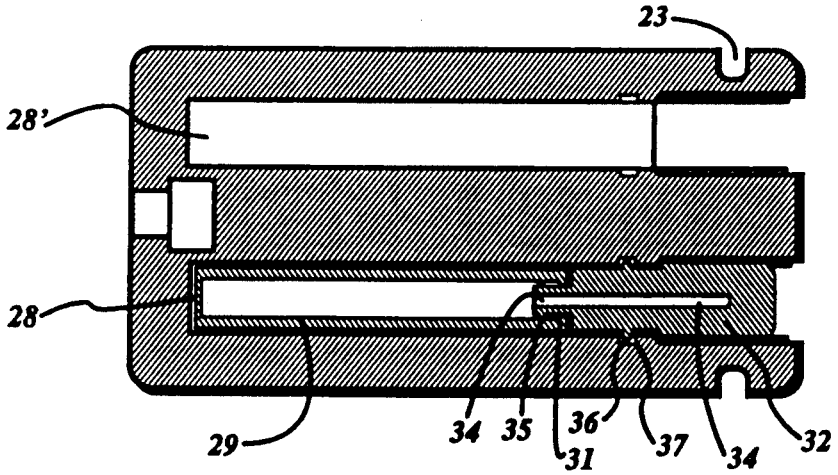
FIG. 10 is a cross section of the inner portion of the embodiment of FIG. 7.

FIGS. 3 and 4 show the inner body 22 of the preferred embodiment in greater detail, revealing in cross section a storage area 28 which can be accessed when the inner body 22 is separated from outer body 21.

Storage area 28 is shown in FIG. 3 and FIG. 4 as including a container consisting of a cap 32 and vial 29. The vial 29 forms an elongated container, with an opening 30 at one end. A raised bead (or "domed" section) 31 is defined around the interior of the vial opening 30.

The cap 32 is designed for a dual purpose: insertion into the vial opening 30 to seal the contents of the vial 29, and insertion into and sealing of the storage area 28. The cap 32 has a textured grip end 33 and two retention rings 35, 36 for positive engagement with the vial 29 and the inner body 22 respectively. The vial retention ring 35 engages with the bead 31 of the vial opening 30, and the cap retention ring 36 engages with cap retention channel 37.

A compression channel 34 begins at the vial plug end 42 of the cap 32 and extends at least partially through the center of the cap. The cap 32 and the vial 29 of the preferred embodiment are made of plastic, and as one possible use of the vial is to carry various substances, the plastic selected should not be affected by or have an affect on the substance the vial is intended for (for example, perfume).

Figure 6:
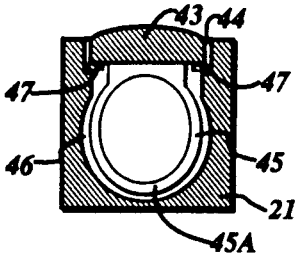
FIG. 6 is a cross section of the outer body member of FIG. 1 taken along line 6—6 of FIG. 2.

The preferred embodiment of FIG. 1 features a release button 43 (see also FIG. 6). The release button 43 is centered within release aperture 44, which passes through the outer body member 21, and rests upon release spring pad 47. The release spring pad 47 is preferably constructed from an elastic material with adhesive on the top and bottom surfaces for attachment to the release button 43 and the outer body member 21. A release loop 45, preferably constructed from nylon or cast metal, is attached to the bottom of the release button 43. The release loop 45 is situated to at least partially occupy release channel 46 inside the outer body member 21.

The outer ring attachment 24 is linked to outer body member 21 in the preferred embodiment by washer 51, which is preferably made of nylon. This washer 51 is manufactured in a 'C' shape and is compressed into outer attachment channel 52, the outer ring attachment is inserted into outer body member 21, and when the washer aligns with outer washer channel 50 the washer expands slightly into the outer channel 50 to securely attach the outer ring attachment 24 to the outer body member.

Figure 7:
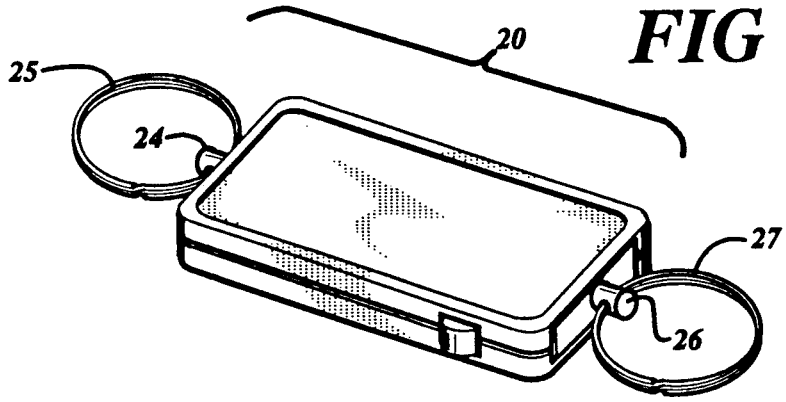
FIG. 7 is a pictorial view of another embodiment of the present invention, with the two body members joined together.
Figure 8:
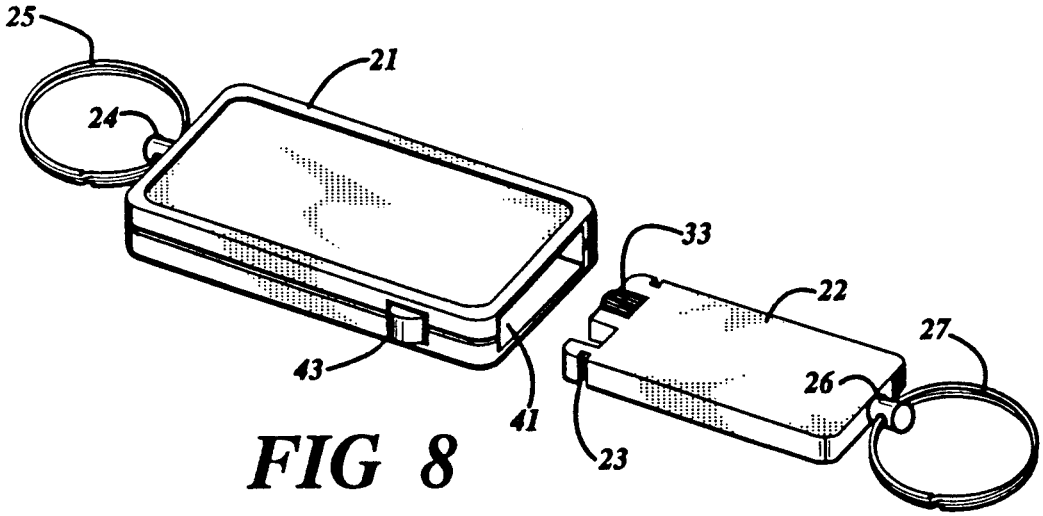
FIG. 8 is a pictorial view of the embodiment of FIG. 7, showing the two body members separated.

The embodiments illustrated in FIGS. 1 and 7 have key rings 25 and 27 attached respectively to outer body member 21 and inner body member 22. Alternate embodiments are contemplated which include only one key ring 25 attached to the outer body member 21.

OPERATION OF THE PREFERRED EMBODIMENT

In operation, the preferred embodiment key chain 20 of FIG. 1 will ordinarily be used with inner body 22 inserted into outer body 21. To access vial 29 the two body members 21, 22 must first be separated. This can be accomplished by depressing the release button 43, and pulling the two key rings 25 and 27 in opposite directions.

Normally, when the inner body member 22 is inside outer body cavity 41, the lower section 45A of release loop 45 is positioned to at least partially occupy inner release channel 23, holding the inner body member inside the outer body cavity. When the release button 43 of the preferred embodiment is pressed, the lower section 45A of release loop 45 moves downward so that it no longer occupies inner release channel 23. When this is done the release loop 45 no longer restrains the inner body member 22, and the inner body member is freed for removal from the outer body member 21. Separating the body members will reveal the cap grip end 33 of cap 32 in storage area 28.

To remove the cap 32 from the inner body member 22, all that is necessary is to grip the cap, as by thumb and forefinger, and pull it out of the inner body member, with the vial being removed with the cap. The compression channel 34 is designed to allow the cap 32 to be compressed in the immediate area of the cap retention ring 36 without releasing the seal between the plug end 42 of the cap and the vial opening 30. Without the compression channel 34, the vial 29 might pop off the plug end 42 of the cap 32 when the cap is removed from the inner body member 22.

Finally, the cap 32 can be removed from the vial 29 to allow access to the interior of the vial. Reversal of this process will return the key chain 20 to its original status.

In alternate uses, the vial is omitted and items (for example, pills) are stored directly in the storage area 28 and sealed with cap 32.

While the preferred embodiment of FIGS. 3 and 4 includes one storage area 28, an alternate embodiment shown in FIGS. 7–11 contains two storage areas 28 and 28'. In this embodiment caps 32 are inserted into storage areas 28, 28' to seal the contents of the storage areas, or the caps are first inserted into a vial 29 before being inserted into the storage areas.

Figure 11:
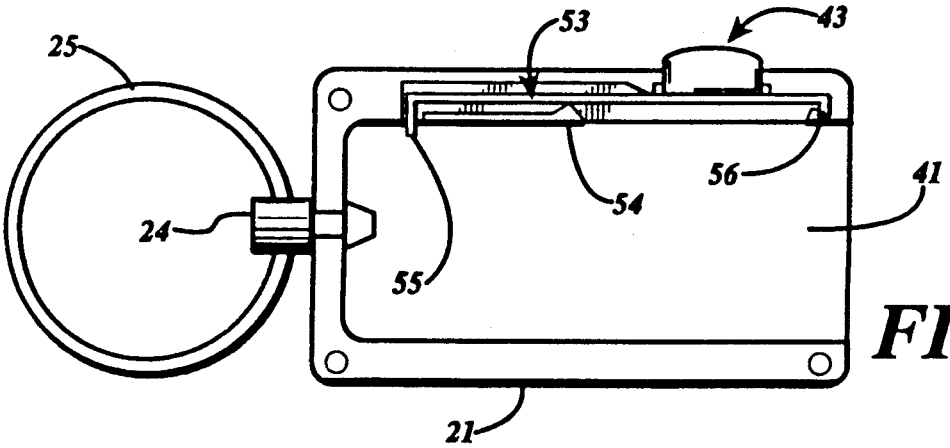
FIG. 11 is a partial detail view of the retention means of FIG. 7.

The outer body member 21 of the embodiment of FIG. 7 utilizes a different release mechanism which is shown in FIG. 11. Here, release button 43 rests against spring arm 53, which has one fixed end 56 and a free end 55. A fulcrum 54 is positioned under the spring arm 53 between the release button 43 and the free end 55. When the inner body member 22 of this embodiment is inserted into cavity 41, the inner release channel 23 catches on the free end 55 of the spring arm 53. Depressing the release button 43 drives the spring arm 53 free end 55 upward, out of release channel 23, and the inner body member 22 can be separated from the outer body member 21.

Whereas the present invention has been described in detail with specific reference to particular embodiments thereof, it will be understood that variations and modifications may be effected within the spirit and scope of the present invention as hereinbefore described and as defined in the appended claims.

I claim:

1. A key chain, comprising:

a body member, said body member having a first end and a second end;

key retention means connected to said body member second end for attaching keys to said body member;

a cavity within said body member, accessible from said body member first end;

a cap;

cap retention means for holding said cap at a position which seals said cavity;

a hollow vial for insertion into said body member cavity, said hollow vial including an opening at one end and a bead around said vial opening; and said cap comprising, at least, a protrusion for insertion into said hollow vial, and a ridge around said cap protrusion which positively engages with said bead to seal said vial opening.

2. Apparatus of claim 1, wherein said cap further comprises a hollow compression channel extending through said protrusion and into said cap.

3. A key chain, comprising:

a first body member, said first body member having a first end and a second end;

key retention means connected to said first body member second end for attaching keys to said first body member;

a cavity within said first body member, accessible from said first body member first end;

a cap;

cap retention means for holding said cap at a position which seals said cavity; and a second body member, said second body member including, at least, a first end and a second end, a cavity accessible from said second body member first end, sized to closely accommodate said first body, and object retention means attached to said second body member second end for attaching keys to said second body member.

4. A key chain, comprising:

a first body member, said first body member having a first end and a second end;

key retention means connected to said first body member second end for attaching keys to said first body member;

a cavity within said first body member, accessible from said first body member first end;

a second body member for insertion into said cavity;

detention means for releasably holding said second body member within said cavity;

said detention means comprising, at least, a channel around said second body member, a loop element attached to said first body member, and means for moving said loop element between a first position in which said loop element partially occupies said channel and a second position in which said loop element does not occupy said channel.

5. Key chain of claim 4, wherein said means for moving said loop element between the first position and the second position comprises an aperture through one side of said first body member, connecting the exterior of said first body member with said cavity; and a push button connected to said loop element, mounted to be accessible from the exterior of said first body member through said aperture.

6. A key chain, comprising:

a first body member, said first body member having a first end and a second end;

key retention means connected to said first body member second end for attaching keys to said first body member;

a cavity within said first body member, accessible from said first body member first end;

a second body member for insertion into said cavity;

detention means for releasably holding said second body member within said cavity;

said second body member having a first end and a second end and comprising, at least, a cavity, accessible from said second body member first end;

a cap for insertion partially into said second body member cavity;

a hollow vial for insertion into said second body member cavity, said hollow vial including an opening at one end and a bead around said vial opening; and said cap further comprising, at least, a protrusion for insertion into said hollow vial, and a ridge around said cap protrusion which positively engages with said bead to seal said vial opening.

7. An apparatus, comprising:

a body member, said body member including, at least, a first end, a second end and a cavity, said cavity accessible from said body member first end;

object retention means connected to said body member second end for attaching keys to said body member;

a flexible cap for insertion partially into said cavity; and cap retention means for holding said cap at a position which seals said cavity.

8. Apparatus of claim 7, wherein said cap retention means comprises an external annular bead on said cap and an annular groove defined in said cavity near said body member first end.

9. An apparatus, comprising:

a first body member, said first body member including, at least a first end, a second end, and a cavity defined therein, said cavity being accessible from said first body member first end;

a second body member, said second body member including, at least, a first end, a second end, and a cavity defined therein, said cavity being accessible from said second body member first end; and detention means for releasably connecting said first body member to said second body member, with said second body member at least partially inserted within said cavity of said first body member, wherein said first body member first end is adjacent to said second body member second end and said first body member second end is adjacent to said second body member first end.

10. Apparatus of claim 9, further comprising object retention means for attaching objects to said apparatus, connected to said second end of one of said first body member and said second body member.

11. Apparatus of claim 9, wherein said detention means further comprises, at least, a channel around said second body member; a loop element attached to said first body member; and means for moving said loop element between a first position in which said loop element partially occupies said channel and a second position in which said loop element does not occupy said channel.

12. Apparatus of claim 11, wherein said means for moving said loop element between the first position and the second position comprises an aperture through one side of said first body member, connecting the exterior of said first body member with said first body member cavity; and a push button connected to said loop element, mounted to be accessible from the exterior of said first body member through said aperture.

13. Apparatus of claim 10, further comprising second object retention means for attaching objects to said apparatus, connected to said second end of the other one of said first body member and said second body member.

14. Apparatus of claim 9, further comprising a cap and cap retention means for holding said cap at a position which seals said cavity of said second body member.

15. Apparatus of claim 14, further comprising a hollow vial for insertion into said second body member cavity, said hollow vial including an opening at one end and a bead around said vial opening; and said cap further comprising, at least, a protrusion for insertion into said hollow vial, and a ridge around said cap protrusion which positively engages with said bead to seal said vial opening.

16. Apparatus of claim 14, wherein said cap retention means comprises an external annular bead on said cap and an annular groove defined in said second body member cavity near said second body member first end.

17. Apparatus of claim 16, further comprising a hollow vial for insertion into said second body member cavity, said hollow vial including an opening at one end and a bead around said vial opening; and said cap further comprising, at least, a protrusion for insertion into said hollow vial, and a ridge around said cap protrusion which positively engages with said bead to seal said vial opening.

18. Apparatus of claim 17, wherein said cap further comprises a hollow compression channel extending through said protrusion and into said cap.

19. A key chain, comprising:

a first body member, said first body member having a first end and a second end;

key retention means connected to said first body member second end for attaching keys to said first body member;

a cavity defined within said first body member, accessible from said first body member first end;

a second body member, including, at least, a first end, a second end, and a cavity defined therein;

detention means for releasable holding said second body member within said cavity of said first body member;

a cap; and cap retention means for holding said cap at a position which seals said cavity of said second body member.

20. Key chain of claim 19, wherein said second body member further comprises object retention means, attached to said second body member second end, for attaching keys to said second body member.

21. Key chain of claim 19, wherein said second body member further comprises a second cavity defined therein.

* * * * *